US009570843B2

(12) United States Patent
Lin et al.

(10) Patent No.: US 9,570,843 B2
(45) Date of Patent: Feb. 14, 2017

(54) CONDUCTIVE STRUCTURE AND ELECTRONIC ASSEMBLY

(71) Applicant: HTC Corporation, Taoyuan County (TW)

(72) Inventors: I-Hsuan Lin, Taoyuan County (TW); Chih-Kai Hu, Taoyuan County (TW); Yi-Ting Liu, Taoyuan County (TW); Yu-Jing Liao, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 12 days.

(21) Appl. No.: 14/303,607

(22) Filed: Jun. 13, 2014

(65) Prior Publication Data

US 2015/0364862 A1 Dec. 17, 2015

(51) Int. Cl.

| | |
|---|---|
| ***H01R 11/30*** | (2006.01) |
| ***H01R 13/62*** | (2006.01) |
| ***H01R 13/703*** | (2006.01) |

(52) U.S. Cl.

CPC ..... *H01R 13/6205* (2013.01); *H01R 13/7037* (2013.01)

(58) Field of Classification Search

CPC .. H01R 13/6205; H01R 11/30; H01R 13/7037
USPC ..... 439/38, 39
See application file for complete search history.

(56) References Cited

U.S. PATENT DOCUMENTS 4,317,969 A * 3/1982 Riegler et al. ..... 200/52 R
6,183,264 B1 * 2/2001 Harsanyi ..... 439/38
6,464,509 B1 * 10/2002 Emberty ..... H01R 13/6205 439/38
6,966,781 B1 * 11/2005 Bullinger et al. ..... 439/38
7,637,746 B2 * 12/2009 Lindberg et al. ..... 439/38
7,997,906 B2 * 8/2011 Ligtenberg et al. ..... 439/38
8,011,931 B2 * 9/2011 Yin ..... G01R 1/06722 324/754.14
8,314,669 B2 * 11/2012 Botsch ..... 335/177
8,680,958 B2 * 3/2014 Radermacher ..... 335/206
(Continued)

FOREIGN PATENT DOCUMENTS

| | | |
|---|---|---|
| JP | H01142174 | 9/1989 |
| TW | 201407315 | 2/2014 |
| TW | 201442355 | 11/2014 |

OTHER PUBLICATIONS

"Office Action of Taiwan Counterpart Application", issued on Mar. 28, 2016, p. 1-6.

*Primary Examiner* — Tulsidas C Patel
*Assistant Examiner* — Peter G Leigh
(74) *Attorney, Agent, or Firm* — Jianq Chyun IP Office

(57) ABSTRACT

A conductive structure, including a holder, a first magnetic element, and a conductive terminal, is provided. The holder has a receiving space. The first magnetic element is disposed in the holder. The conductive terminal is disposed in the receiving space corresponding to the first magnetic element. The conductive terminal is attracted to the first magnetic element and is hidden in the receiving space of the holder. When the conductive terminal is moved close to a conductive contact provided with a second magnetic element, the conductive terminal is attracted to the second magnetic element and moves from the receiving space to be in contact with and electrically connected with the conductive contact. An electronic assembly, including a housing and the conductive structure, is also provided.

8 Claims, 4 Drawing Sheets

(56) References Cited

U.S. PATENT DOCUMENTS

| | | | | |
|---|---|---|---|---|
| 8,734,165 | B2 * | 5/2014 | Neel | 439/39 |
| 9,059,523 | B2 * | 6/2015 | Enomoto | H01H 1/54 |
| 9,088,098 | B2 * | 7/2015 | Hwang | |
| 2009/0111287 | A1 * | 4/2009 | Lindberg et al. | 439/39 |
| 2012/0282786 | A1 * | 11/2012 | Neel | H01R 11/30 439/39 |
| 2013/0295781 | A1 * | 11/2013 | Gualino | H01R 13/2421 439/39 |
| 2014/0055931 | A1 * | 2/2014 | Lin et al. | 361/679.01 |
| 2014/0192494 | A1 * | 7/2014 | Liang et al. | 361/752 |
| 2014/0287601 | A1 * | 9/2014 | Suh | H01R 13/6205 439/39 |

* cited by examiner

CONDUCTIVE STRUCTURE AND ELECTRONIC ASSEMBLY

BACKGROUND OF THE INVENTION

Field of the Invention

The application relates to a conductive structure and more particularly relates to an electronic assembly using the conductive structure.

Description of Related Art

In recent years, as the technology industries develop, electronic devices, such as smart phones, tablet computers, and notebook computers, have become very common in our daily life. The styles and functions of the electronic devices are becoming more and more diverse. Because of the convenience and practicality, these electronic devices become more popular and can be used for different purposes according to the user's needs. For example, the electronic devices may be provided with basic functions, such as communication, network access, Word processing, etc., as required. In addition, the electronic device is usually equipped with a corresponding connection assembly for connecting the electronic device with other external electronic devices to add functions, such as audio and video playback, data transmission, and charging. A connection terminal of the common connection assembly usually extends outside the housing of the electronic device such that the electronic device can be directly installed on the external electronic device and connected with the external electronic device through the connection terminal extending outside the housing. However, when the electronic device is not connected with the external electronic device, the connection terminal that extends outside the housing may be deformed by an external force easily, and it also affects the appearance of the electronic device.

SUMMARY OF THE INVENTION

The application provides a conductive structure and an electronic assembly, including a hidden conductive terminal.

The conductive structure of the application includes a holder, a first magnetic element, and a conductive terminal. The holder has a receiving space. The first magnetic element is disposed in the holder. The conductive terminal is disposed in the receiving space corresponding to the first magnetic element. The conductive terminal is attracted to the first magnetic element and is hidden in the receiving space of the holder. When the conductive terminal is moved close to a conductive contact provided with a second magnetic element, the conductive terminal is attracted to the second magnetic element and moves from the receiving space to be in contact with and electrically connected with the conductive contact.

The electronic assembly of the application includes a housing and a conductive structure. The conductive structure is assembled to the housing. The conductive structure includes a holder, a first magnetic element, and a conductive terminal. The holder is assembled to the housing and has a receiving space. The first magnetic element is disposed in the holder. The conductive terminal is disposed in the receiving space corresponding to the first magnetic element. The conductive terminal is attracted to the first magnetic element and is hidden in the receiving space of the holder. When the conductive terminal is moved close to a conductive contact provided with a second magnetic element, the conductive terminal is attracted to the second magnetic element and moves from the receiving space to be in contact with and electrically connected with the conductive contact.

Based on the above, in the conductive structure and the electronic assembly of the application, the conductive terminal is attracted to the first magnetic element disposed in the holder and is hidden in the receiving space of the holder. In the case that the user intends to connect the conductive terminal with the conductive contact, when the conductive terminal is moved close to the conductive contact provided with the second magnetic element, the conductive terminal is attracted to the second magnetic element and moves from the receiving space to be in contact with and electrically connected with the conductive contact. Accordingly, the conductive structure and the electronic assembly of the application are provided with the hidden conductive terminal, and the conductive terminal can be automatically hidden or moved out of the holder by attraction of the magnetic elements.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1:
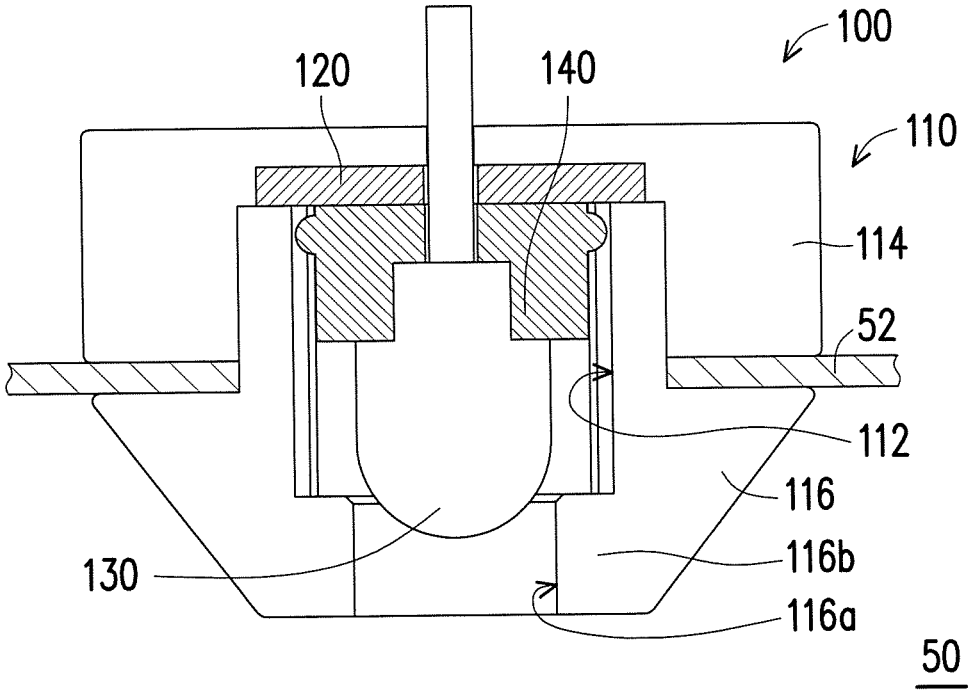
FIG. 1 is a schematic view of an electronic assembly according to an embodiment of the invention.
Figure 2:
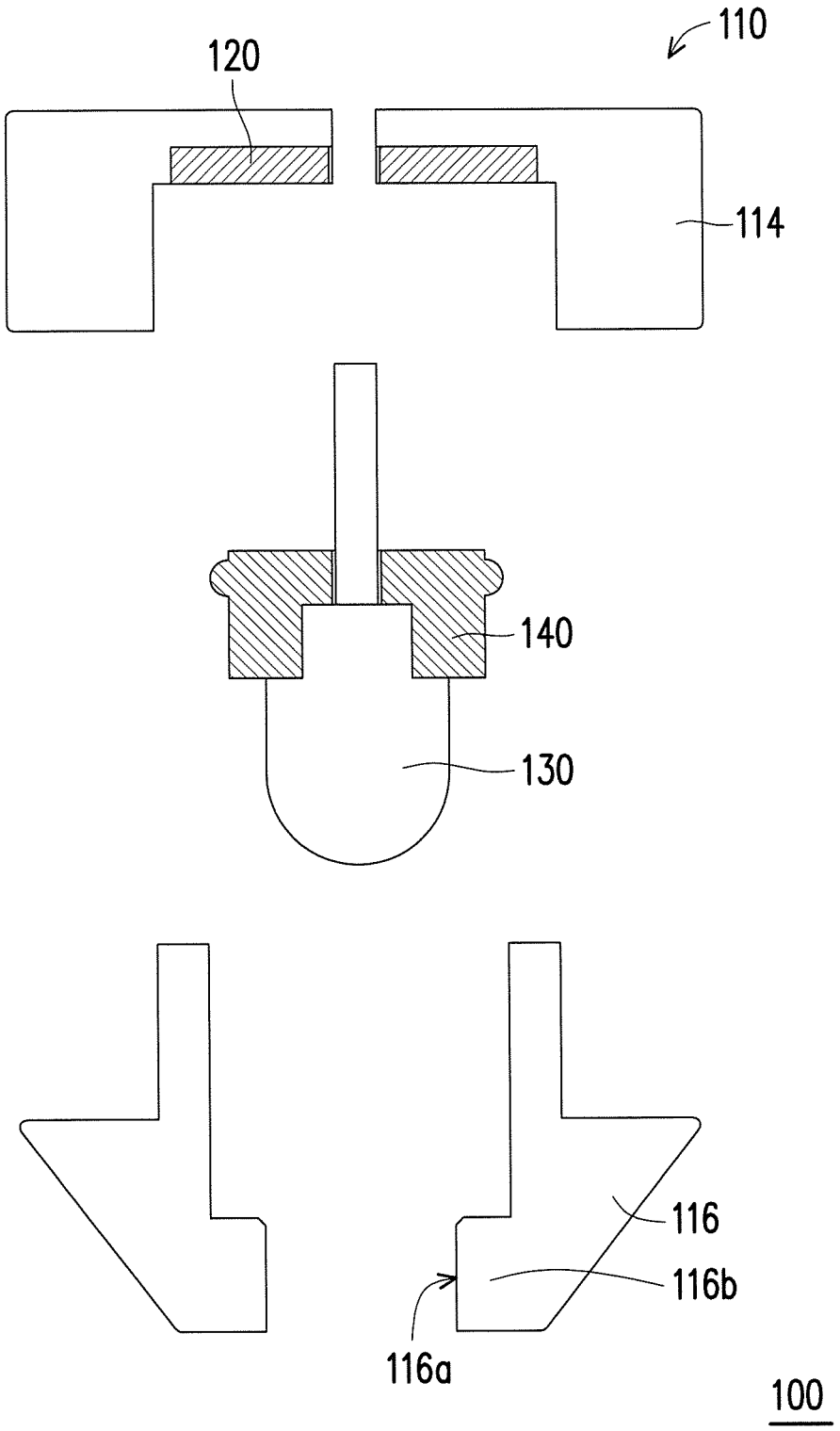
FIG. 2 is a schematic exploded view of a conductive structure of FIG. 1.

FIG. 1 is a schematic view of an electronic assembly according to an embodiment of the invention. FIG. 2 is a schematic exploded view of a conductive structure of FIG. 1. With reference to FIG. 1 and FIG. 2, in this embodiment, an electronic assembly 50 includes a housing 52 and a conductive structure 100. The conductive structure 100 is assembled to the housing 52. The conductive structure 100 includes a holder 110, a first magnetic element 120, and a conductive terminal 130. The holder 110 is assembled to the housing 52 and has a receiving space 112. More specifically, the holder 110 of this embodiment includes a first portion 114 and a second portion 116. The first portion 114 and the second portion 116 are connected with each other to form the receiving space 112, and the second portion 116 has an opening 116*a* facing outward of the housing 52. The first magnetic element 120 is disposed on the first portion 114 in the holder 110 corresponding to the receiving space 112. The conductive terminal 130 is disposed in the receiving space 112 corresponding to the first magnetic element 120. Accordingly, the conductive terminal 130 is attracted to the first magnetic element 120 and is hidden in the receiving space 112 of the holder 110.

Figure 4:
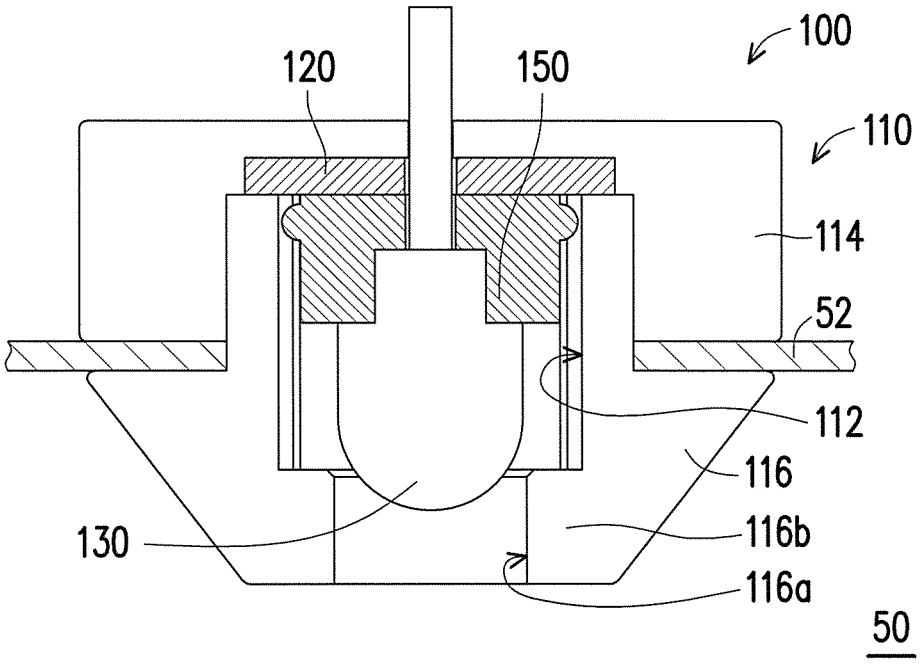
FIG. 4 is a schematic view of the electronic assembly of to another embodiment of the invention in an operation state.

To be more specific, in this embodiment, the conductive structure 100 further includes a third magnetic element 140 disposed on the conductive terminal 130 corresponding to the first magnetic element 120. The first magnetic element 120 and the third magnetic element 140 are permanent magnets or other suitable magnetic elements, for example. Thus, the conductive terminal 130 is attracted to the first magnetic element 120 through the third magnetic element 140, so as to be hidden in the receiving space 112 of the holder 110. To be more specific, a magnetic force generated between the first magnetic element 120 and the third magnetic element 140 drives the conductive terminal 130 connected with the third magnetic element 140 to move close to the first magnetic element 120, so as to hide the conductive terminal 130 in the receiving space 112 of the holder 110. However, the application is not restricted to using the third magnetic element 140 to achieve the above. In other embodiments, as shown in FIG. 4, which is a schematic view of the electronic assembly of to another embodiment of the invention in an operation state, the third magnetic element 140 may be replaced by a magnetic sensing element 150. More specifically, the magnetic sensing element 150 is disposed on the conductive terminal 130 corresponding to the first magnetic element 120, which is for example at a location of the third magnetic element 140 as shown in FIG. 1 to replace the third magnetic element 140. The magnetic sensing element 150 is an iron plate or other suitable magnetic sensing elements, for example. Thus, the conductive terminal 130 is attracted to the first magnetic element 120 through the magnetic sensing element 150 to be hidden in the receiving space 112 of the holder 110. In other words, a magnetic force generated between the first magnetic element 120 and the magnetic sensing element 150 drives the conductive terminal 130 connected with the magnetic sensing element 150 to move close to the first magnetic element 120, so as to hide the conductive terminal 130 in the receiving space 112 of the holder 110. Accordingly, the conductive terminal 130 is automatically hidden in the holder 110 by the magnetic force, so as to reduce the probability of deformation of the conductive terminal 130 caused by an external force and maintain beautiful external shapes of the electronic assembly 50 and the conductive structure 100.

Figure 3:
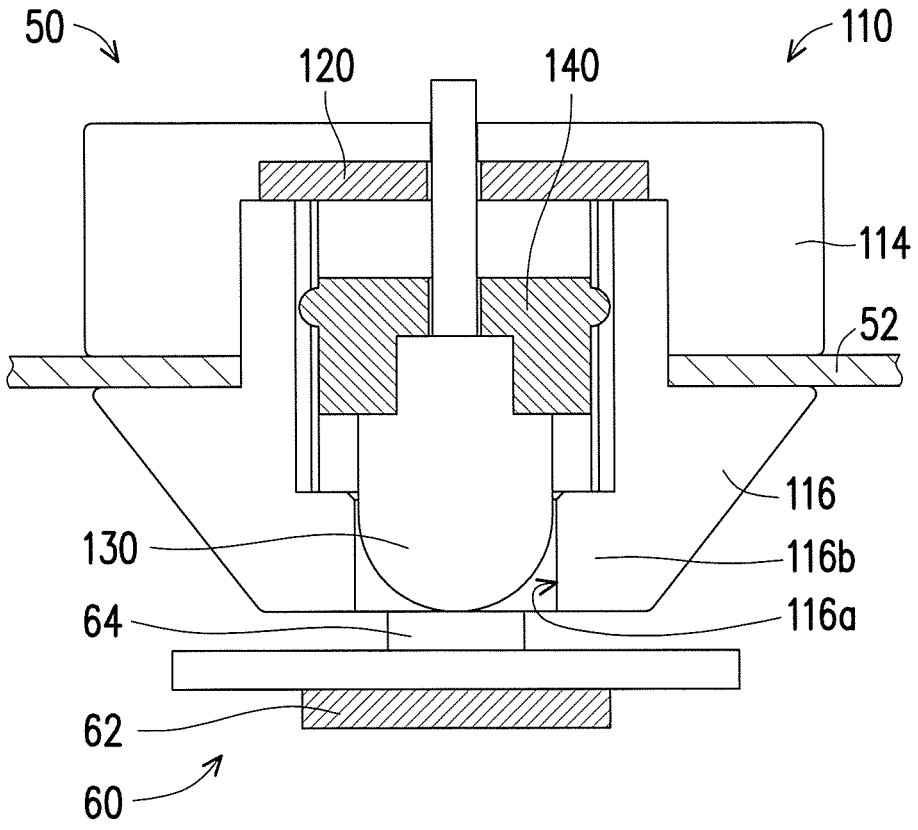
FIG. 3 is a schematic view of the electronic assembly of FIG. 1 in an operation state.

FIG. 3 is a schematic view of the electronic assembly of FIG. 1 in an operation state. With reference to FIG. 1 to FIG. 3, in this embodiment, the electronic assembly 50 may be connected to a power assembly 60, such as a charging plate for charging. The power assembly 60 includes a second magnetic element 62 and a conductive contact 64. Thus, in the case that the user intends to electrically connect the electronic assembly 50 with the power assembly 60 through connection of the conductive terminal 130 and the conductive contact 64, when the conductive terminal 130 is moved close to the conductive contact 64 provided with the second magnetic element 62, the conductive terminal 130 is attracted to the second magnetic element 62 and moves from the receiving space 112 of the holder 110 to be in contact with and electrically connected with the conductive contact 64, so as to transmit a power signal between the conductive terminal 130 and the conductive contact 64. Furthermore, the second magnetic element 62 is a permanent magnet or other suitable magnetic elements, for example. A magnetic force generated between the second magnetic element 62 and the third magnetic element 140 drives the conductive terminal 130 connected with the third magnetic element 140 to move close to the second magnetic element 62. Thus, the conductive terminal 130 is attracted to the second magnetic element 62 through the third magnetic element 140 disposed thereon and moves outward from the receiving space 112 of the holder 110 to be in contact with and electrically connected with the conductive contact 64 through the opening 116*a* of the second portion 116, so as to transmit the power signal from the power assembly 60 to the electronic assembly 50 through the conductive contact 64 and the conductive terminal 130.

In addition, in this embodiment, a first magnetic force between the first magnetic element 120 and the conductive terminal 130 is smaller than a second magnetic force between the second magnetic element 62 and the conductive terminal 130. More specifically, in this embodiment, the first magnetic force constantly exists between the first magnetic element 120 and the conductive terminal 130. Therefore, using a magnetic element having a greater magnetic force as the second magnetic element 62 can make the second magnetic force between the second magnetic element 62 and the conductive terminal 130 greater than the first magnetic force between the first magnetic element 120 and the conductive terminal 130, such that even though the first magnetic force exists between the first magnetic element 120 and the conductive terminal 130, the conductive terminal 130 is attracted to the second magnetic element 62 and moves toward the conductive contact 64 provided with the second magnetic element 62 to be in contact with and electrically connected with the conductive contact 64. Moreover, according to the structure of the power assembly 60, the conductive terminal 130 attracted to the second magnetic element 62 does not need to move completely out of the holder 110 as long as the conductive terminal 130 can move relative to the holder 110 by the attraction of the second magnetic element 62 to be in contact with and electrically connected with the conductive contact 64, as shown in FIG. 3. Nevertheless, it should be noted that the application is not limited thereto. In other embodiments, when the electronic assembly 50 is connected to other power assemblies, the conductive terminal 130 may also extend out of the holder 110 after being attracted to the second magnetic element of the power assembly. Accordingly, in this embodiment, the second portion 116 of the holder 110 further includes a restricting portion 116*b* disposed at a side of the opening 116*a* for restricting a location of the conductive terminal 130 relative to the opening 116*a*. In other words, when the conductive terminal 130 is attracted to the second magnetic element to move outward of the holder 110 through the opening 116*a*, the third magnetic element 140 disposed on the conductive terminal 130 or a portion of the conductive terminal 130 interferes with the restricting portion 116*b* near the opening 116*a* to limit a length of the conductive terminal 130 that extends out of the holder 110, so as to prevent the conductive terminal 130 from falling out of the holder 110. However, the application does not necessarily include the restricting portion 116*b*, which can be determined according to the actual requirement. The movement of the conductive terminal 130 may be stopped by the conductive contact 64 when the conductive terminal 130 comes in contact with the conductive contact 64. Thus, when connecting the conductive terminal 130 with the power assembly 60, the conductive terminal 130 hidden in the holder 110 automatically moves to be in contact with and electrically connected with the conductive contact 64 of the power assembly 60 by the magnetic force.

However, the application is not limited to the above embodiments. In other embodiments, the electronic assembly 50 may serve as a power assembly, such as a charging stand, for connection with an electronic element not illustrated here, such that the electronic element that requires charging is charged by the electronic assembly 50 used as the power assembly. The electronic element may include the aforementioned second magnetic element and conductive contact. Therefore, in the case that the user intends to electrically connect the electronic assembly 50 with the electronic element through connection of the conductive terminal 130 and the conductive contact, when the conductive terminal 130 is moved close to the conductive contact provided with the second magnetic element, the conductive terminal 130 is attracted to the second magnetic element and moves from the receiving space 112 of the holder 110 to be in contact with and electrically connected with the conductive contact, so as to transmit the power signal from the electronic assembly 50 to the electronic element through the conductive terminal 130 and the conductive contact. Accordingly, it is known that the conductive structure 100 of this embodiment is not only applicable to the electronic assembly that supplies power or the electronic assembly that requires charging. In other words, the conductive structure 100 of this embodiment is applicable to a variety of electronic assemblies. For example, the power assembly 60 and the electronic assembly 50 may be respectively disposed on different electronic elements, and an electronic signal is transmitted between the power assembly 60 and the electronic assembly 50 through the conductive contact 64 and the conductive terminal 130. Simply put, the conductive contact 64 and the conductive terminal 130 can be used not only for transmitting current but also for transmitting electrical signals.

Referring to FIG. 1 and FIG. 3 again, in this embodiment, after the transmission of the power signal between the electronic assembly 50 and the power assembly 60 is completed, the electronic assembly 50 is moved away from the power assembly 60 so as to separate the conductive terminal 130 of the electronic assembly 50 from the conductive contact 64 of the power assembly 60. After the electronic assembly 50 is separated from the power assembly 60 for a specific distance, the second magnetic force between the second magnetic element 62 of the power assembly 60 and the conductive terminal 130 gradually decreases and disappears. When the power assembly 60 is moved to cause the second magnetic force between the second magnetic element 62 and the conductive terminal 130 to become smaller than the first magnetic force between the first magnetic element 120 and the conductive terminal 130, the conductive terminal 130 is attracted to the first magnetic element 120 and moves toward the first magnetic element 120 to be hidden in the receiving space 112 of the holder 110 again. Based on the above, the conductive structure 100 and the electronic assembly 50 of this embodiment include the hidden conductive terminal 130, and the conductive terminal 130 can be automatically hidden or moved out of the holder 110 by attraction of the magnetic elements, so as to reduce the probability of deformation of the conductive terminal 130 caused by an external force.

To sum up, in the conductive structure and the electronic assembly of the application, when the conductive terminal is not connected with the conductive contact, the first magnetic force is generated between the conductive terminal and the first magnetic element to attract the conductive terminal to the first magnetic element disposed in the holder and hide the conductive terminal in the receiving space of the holder. In the case that the user intends to connect the conductive terminal with the conductive contact, when the conductive terminal is moved close to the conductive contact provided with the second magnetic element, the second magnetic force is generated between the conductive terminal and the second magnetic element, and the second magnetic force is greater than the first magnetic force, such that the conductive terminal is attracted to the second magnetic element and moves from the receiving space to be in contact with and electrically connected with the conductive contact. Accordingly, the conductive structure and the electronic assembly of the application include the hidden conductive terminal, and the conductive terminal can be automatically hidden or moved out of the holder by attraction of the magnetic elements, so as to reduce the probability of deformation of the conductive terminal caused by an external force.

It will be apparent to those skilled in the art that various modifications and variations can be made to the disclosed embodiments without departing from the scope or spirit of the invention. In view of the foregoing, it is intended that the invention covers modifications and variations of this disclosure provided that they fall within the scope of the following claims and their equivalents.

What is claimed is:

1. A conductive structure, comprising:

a holder comprising a receiving space;

a first magnetic element disposed in the holder;

a conductive terminal disposed in the receiving space corresponding to the first magnetic element, wherein the conductive terminal is attracted to the first magnetic element to be hidden in the receiving space of the holder, and when the conductive terminal is moved close to a conductive contact provided with a second magnetic element, the conductive terminal is adapted to being attracted to the second magnetic element and moving from the receiving space to be in contact with and electrically connected with the conductive contact; and a third magnetic element disposed on the conductive terminal corresponding to the first magnetic element, wherein the conductive terminal is attracted to the first magnetic element through the third magnetic element, and the conductive terminal is adapted to being attracted to the second magnetic element through the third magnetic element.

2. The conductive structure according to claim 1, wherein a first magnetic force between the first magnetic element and the conductive terminal is smaller than a second magnetic force between the second magnetic element and the conductive terminal.

3. The conductive structure according to claim 1, wherein the holder comprises a first portion and a second portion, wherein the first portion and the second portion are connected with each other to form the receiving space, and the second portion comprises an opening, wherein the first magnetic element is disposed on the first portion, and the conductive terminal is adapted to being in contact with the conductive contact through the opening of the second portion.

4. The conductive structure according to claim 3, wherein the second portion comprises a restricting portion disposed at a side of the opening for restricting a location of the conductive terminal relative to the opening.

5. An electronic assembly, comprising:

a housing; and a conductive structure assembled to the housing and comprising:

a holder assembled to the housing and comprising a receiving space;

a first magnetic element disposed in the holder;

a conductive terminal disposed in the receiving space corresponding to the first magnetic element, wherein the conductive terminal is attracted to the first magnetic element to be hidden in the receiving space of the holder, and when the conductive terminal is moved close to a conductive contact provided with a second magnetic element, the conductive terminal is adapted to being attracted to the second magnetic element and moving from the receiving space to be in contact with and electrically connected with the conductive contact; and a third magnetic element disposed on the conductive terminal corresponding to the first magnetic element, wherein the conductive terminal is attracted to the first magnetic element through the third magnetic element, and the conductive terminal is adapted to being attracted to the second magnetic element through the third magnetic element.

6. The electronic assembly according to claim 5, wherein a first magnetic force between the first magnetic element and the conductive terminal is smaller than a second magnetic force between the second magnetic element and the conductive terminal.

7. The electronic assembly according to claim 5, wherein the holder comprises a first portion and a second portion, wherein the first portion and the second portion are connected with each other to form the receiving space, and the second portion comprises an opening, wherein the first magnetic element is disposed on the first portion, and the conductive terminal is adapted to being in contact with the conductive contact through the opening of the second portion.

8. The electronic assembly according to claim 7, wherein the second portion comprises a restricting portion disposed at a side of the opening for restricting a location of the conductive terminal relative to the opening.

* * * * *